US009276344B2

(12) United States Patent
Schmatz et al.

(10) Patent No.: US 9,276,344 B2
(45) Date of Patent: Mar. 1, 2016

(54) PLUG CONNECTOR HAVING NOVEL PRIMARY LOCKING HOOKS

(71) Applicants: Ulrich Schmatz, Besigheim (DE); Wolfgang Pade, Illingen (DE)

(72) Inventors: Ulrich Schmatz, Besigheim (DE); Wolfgang Pade, Illingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/250,257

(22) Filed: Apr. 10, 2014

(65) Prior Publication Data

US 2014/0308856 A1 Oct. 16, 2014

(30) Foreign Application Priority Data

Apr. 12, 2013 (DE) ..... 10 2013 206 561

(51) Int. Cl.
*H01R 13/424* (2006.01)
*H01R 13/436* (2006.01)
*H01R 13/422* (2006.01)

(52) U.S. Cl.
CPC ..... *H01R 13/424* (2013.01); *H01R 13/422* (2013.01); *H01R 13/4223* (2013.01); *H01R 13/4364* (2013.01); *H01R 13/4365* (2013.01)

(58) Field of Classification Search
CPC ..... H01R 13/4223; H01R 13/4365; H01R 13/422; H01R 13/4364
USPC ..... 439/595, 744
See application file for complete search history.

(56) References Cited

U.S. PATENT DOCUMENTS 5,421,744 A * 6/1995 Hio ..... H01R 13/4361 439/595
2014/0295708 A1* 10/2014 Omori ..... H01R 13/422 439/626

* cited by examiner

*Primary Examiner* — Abdullah Riyami
*Assistant Examiner* — Justin Kratt
(74) *Attorney, Agent, or Firm* — Kenyon & Kenyon LLP

(57) ABSTRACT

A connector element includes: at least two contact elements; and at least one latching element which has two diametrically opposed detents, which latching element is situated between the at least two contact elements. The at least one latching element is configured to be pivotable or bendable, and the two contact elements each have a recess for establishing a form-fit connection to one of the detents of the latching element. The recess is further configured to enable the latching element to be pivoted or bent in the direction of one of the two contact elements, so that the form-fit connection between the other contact element and the associated detent is able to be released.

8 Claims, 2 Drawing Sheets

PLUG CONNECTOR HAVING NOVEL PRIMARY LOCKING HOOKS

BACKGROUND OF THE INVENTION

1. Field of the Invention

The present invention relates to a plug connector technology for automotive applications.

2. Description of the Related Art

In conventional connector elements for automotive applications, contact elements are introduced into a contact carrier, for example, the housing of the connector element, after crimping, i.e., the connection of a cable to a contact element. In this context, the contact elements lock a so-called primary locking lance using either a flexible element on the contact element, or by a flexible element in the connector housing, which engages in a corresponding recess on the contact element.

For contact elements having a primary locking lance, it is frequently possible to achieve higher chamber extraction forces for a given overall size, since plastic undercuts provided for locking may be designed to be larger than plastic locking hooks of the connector element.

Conventional plastic locking hooks are frequently made up of a flexible bar, to which a detent is attached, which engages in an opening in the contact element or on an edge on the contact element.

FIGS. 1*a* through 1*c* show embodiments of connector elements.

Connector elements having chambers into which the contact elements may be introduced are known. These chambers have locking hooks (see FIG. 1*a*) situated at a position, for example, on a rear wall. These locking hooks 6 engage in openings 16 of a contact element 4 and lock it, so that contact element 4 is prevented from being extracted from or sliding out of housing 14 of a connector element 2.

Another embodiment uses locking hooks, in which the movement of the hooks is not limited by chamber walls. The elimination of rear or intermediate spaces between contact elements and latching elements makes it possible to reduce the space requirement per chamber.

The movement of a locking hook 6 may occur, for example, in a recess, which is present in any case, or also in the direction of an additional locking hook 6 (see FIG. 1*b*). Alternatively, a locking hook 6 may also be used in the direction of an additional contact chamber on the side facing away from separate locking hook 6 (see FIG. 1*c*). For this purpose, in particular the removal of a contact element may require the previous removal of an additional contact element 4. In particular, compared to FIG. 1*c*, it may be necessary to remove right contact element 4 first in order to subsequently be able to remove left contact element 4. On the other hand, it may thus be possible to fix left contact element 4 using right contact element 4. Thus, depending on the system, limitations may be present with respect to the assembly sequence of the individual contacts (see FIG. 1*c*).

The dimensioning of a locking hook and thus also the buckling resistance to the extraction force are directly incorporated in the achievable row spacing in plug connector 2.

BRIEF SUMMARY OF THE INVENTION

One aspect of the present invention may be seen in providing a locking concept using locking hooks in the housing of a connector element, which on the one hand makes it possible for the contacts to have high retention forces against extraction, and on the other hand minimizes the space requirements.

According to the present invention, two contact elements are in each case held in their position in the connector element by a locking hook situated between them having diametrically opposed detents. The two contact elements form, for example, a row of the connector element. Connector elements may in this connection be expanded arbitrarily and have both a plurality of rows just described and also more than two contact elements in one row.

In this connection, a latching element may be provided between each contact element. Alternatively, at least two adjacent contact elements each may be held in pairs by a latching element, in each case supplemented by two additional contact elements as well as one locking hook per row of the connector element. The latching elements have diametrically opposed detents, which engage in suitably formed openings in the contact element and fix it or set it in a form-fit connection. The openings may be designed in such a way that the latching element situated between two contact elements is pivotable or bendable in the direction of one of the two contact elements, resulting in the release of the form-fit connection to the other of the two contact elements, so that it is removable from the connector element or from the housing and in particular from the particular chamber of the contact element.

The combination of two detents on one latching element while using a flexible bar may reduce in particular the space requirement for a latching element per contact with essentially the same geometrical dimensioning and consequently comparable stability. Alternatively, a larger dimensioning of the flexible latching element may provide increased stability without requiring more space compared to known connector elements.

A connector element according to the present invention is thus designed in such a way that the detent of a latching element may be inserted unhindered into the particular other contact element or its recess during assembly or disassembly of a contact element, in order to thus release the particular contact element in which the latching element is not momentarily inserted.

Embodiments of the present invention are represented in the drawings and are elucidated in greater detail in the following description.

DETAILED DESCRIPTION OF THE INVENTION

Figure 1C:
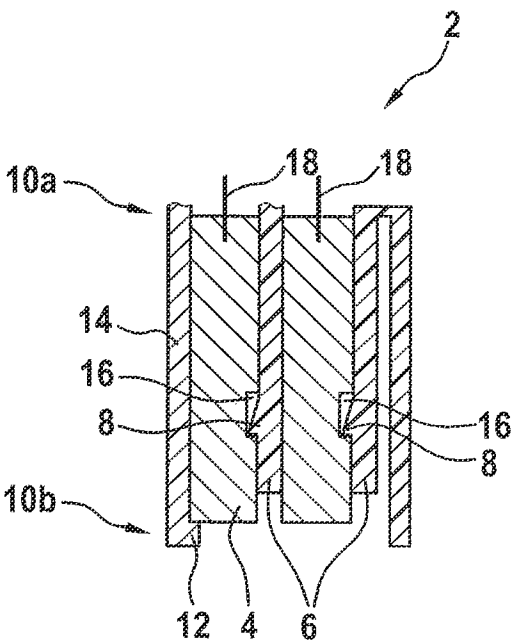
Fig. 1c prior art
FIGS. 1*a*-1*c* show conventional connector elements.
Figure 1B:
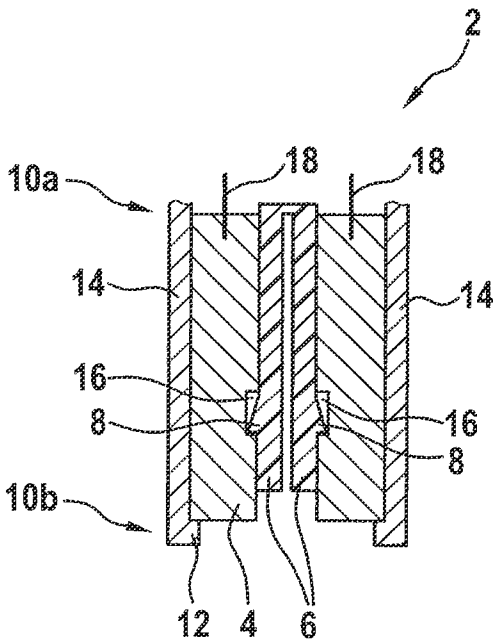
Fig. 1b prior art
Figure 1A:
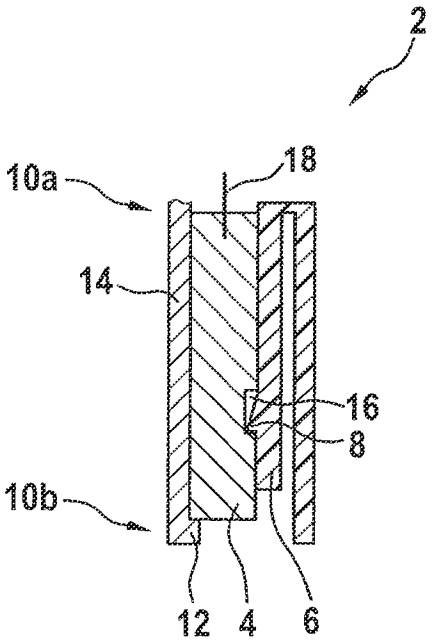
Fig. 1a prior art
Figure 2B:
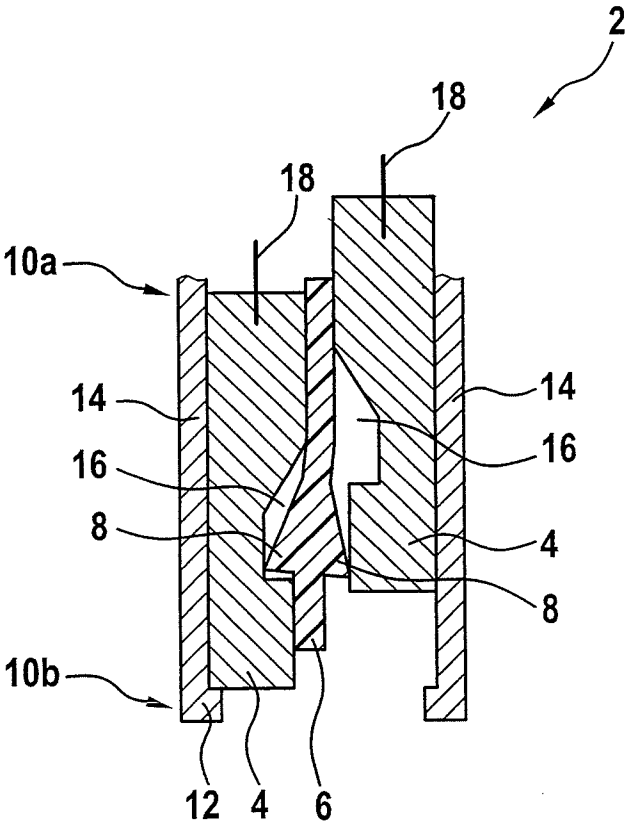
FIGS. 2*a* and 2*b* show an exemplary embodiment of a connector element in the assembled state and during assembly/disassembly according to the present invention.
Figure 2A:
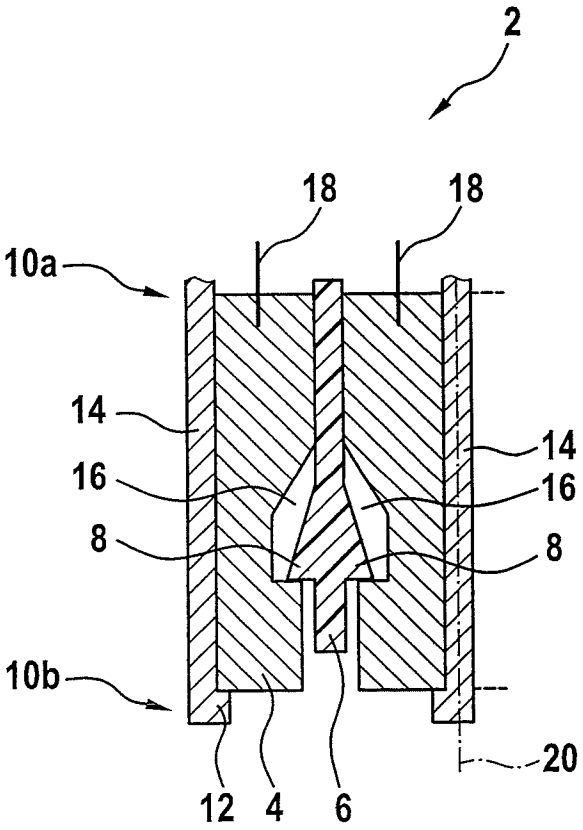

FIG. 2*a* shows a system of a connector element 2 in cross section, it being made up of a connector row of two contact elements 4 having an internal latching element 6. Latching element 6 has two diametrically opposed detents 8, which engage in suitably formed recesses 16 of contact elements 4, and provide a form-fit connection there by surface contact.

Connector element 2 has a terminal side 10*b* as well as a contact feed side 10*a*. Via terminal side 10*b*, connector element 2 is in conductive contact with a suitably designed connecting element, while individual contact elements 4 are introduced into housing 14 of connector element 2 via contact feed side 10*a*. Suitably designed elements 12 prevent contact elements 4 from sliding out of housing 14 of connector element 2 in the direction of terminal side 10*b*. Elements 12 and their functionality are only depicted schematically in the drawings.

Latching element 6 is formed to be pivotable or bendable, for example, from a suitable plastic, and may be pivoted in such a way that detents 8 penetrate into recesses 16 to a varying depth, in particular they penetrate far enough into recess 16 that the form-fit connection of particular diametrically opposed detent 8 to corresponding recess 16 of additional contact element 4 is released. This may subsequently be removed from connector element 2. When a contact 4 is introduced into connector element 2, latching element 6 is pivoted into the particular diametrically opposed position essentially automatically, so that no special or separate assembly step is required when the contact elements are assembled. On contact feed side 10*a*, contact elements 4 have a cable connection 18 which is depicted schematically in FIGS. 2*a, b*. Using cable elements 18, it is thus possible to establish a conductive contact across terminal side 10*b* via contact elements 4.

The system according to the present invention may have both "male" and "female" contact elements, thus plug as well as socket elements.

FIG. 2*b* shows the system of a latching element 6 during assembly or disassembly of a contact element 4. As an example, latching element 6 is completely moved or pivoted in recess 16 of left contact element 4 using left detent 8 of latching element 6. This releases the form-fit connection to right contact element 4, so that it may be removed from housing 14 or may be introduced into its locking chamber of connector element 2. Such a pivoting of latching element 6 may be carried out, for example, by a manual intervention from the direction of terminal side 10*b*.

Connector element 2 may have a plurality of contact rows shown in FIGS. 2*a, b*, which could extend perpendicularly to the drawing plane. One embodiment of a connector element having, for example, one contact row having four contact elements 4 is implementable by continuing the system according to FIGS. 2*a,b* in a similar manner on an outer side, an outer side of housing 14 becoming an inner wall situated in the housing, to which a connector element system as shown, for example, in FIG. 2*a* is adjoined to the left and right. For example, a connector element 2 may thus be provided, the structure of which is mirrored on axis 20. Any continuation for forming contact rows having 6, 8, 10, 12, etc., contact elements is also conceivable.

Alternatively, the locking according to the present invention may also be used for an odd number of contact elements per connector row, for example, 3, 5, 7, 9, etc., and engage detents, for example, from both sides into one (internal) contact element. This makes it possible, for example, to further increase the retention force available, at least for internal contact elements or those not adjoining an outer wall, by two form-fit connections provided per contact element.

What is claimed is:

1. A connector element, comprising:

at least two contact elements; and at least one latching element having two diametrically opposed detents, wherein the at least one latching element is situated between the at least two contact elements, and wherein the at least one latching element is configured to be at least one of pivotable and bendable;

wherein the two contact elements each have a recess which is configured for (i) establishing a form-fit connection to one of the detents of the latching element, and (ii) enabling the latching element to be at least one of pivoted and bent in the direction of one of the contact elements, so that the form-fit connection between the other contact element and the associated detent is able to be released.

2. The connector element as recited in claim 1, wherein the at least two contact elements and the at least one latching element form a contact row of the connector element, and wherein the connector element has a plurality of contact rows.

3. The connector element as recited in claim 2, further comprising:

at least one third contact element; and at least one additional latching element;

wherein one latching element is situated between every two contact elements.

4. The connector element as recited in claim 2, further comprising:

at least one third contact element and one fourth contact element; and at least one additional latching element;

wherein one of every two latching elements is not situated between every two contact elements.

5. The connector element as recited in claim 3, wherein the at least three contact elements and the at least two latching elements form a contact row of the connector element, and wherein the connector element has a plurality of contact rows.

6. The connector element as recited in claim 3, further comprising:

a housing having a terminal side and a contact feed side, wherein the housing is configured in such a way that (i) a contact element is introduced into the housing from the contact feed side without the contact element being able to slide out of the housing on the terminal side, and (ii) an electrically conductive terminal is implemented on the connector element on the terminal side.

7. The connector element as recited in claim 6, wherein the connector element is part of a cable element.

8. The connector element as recited in claim 7, wherein the connector element is part of a cable element of an automobile.

* * * * *